United States Patent [19]

Rotolico et al.

[11] Patent Number: 4,999,225

[45] Date of Patent: Mar. 12, 1991

[54] HIGH VELOCITY POWDER THERMAL SPRAY METHOD FOR SPRAYING NON-MELTABLE MATERIALS

[75] Inventors: Anthony J. Rotolico, Hauppauge; Burton A. Kushner, Old Bethpage; Amr Aly, Forest Hills, all of N.Y.

[73] Assignee: The Perkin-Elmer Corporation, Norwalk, Conn.

[21] Appl. No.: 290,928

[22] Filed: Jan. 5, 1989

[51] Int. Cl.[5] ..... B05D 1/08

[52] U.S. Cl. ..... 427/423; 427/189; 427/190; 427/192; 427/427

[58] Field of Search ..... 427/422, 423, 427, 189, 427/190, 192

[56] References Cited

U.S. PATENT DOCUMENTS

| | | | |
|---|---|---|---|
| 2,317,173 | 2/1940 | Bleakley | 91/12.2 |
| 2,714,563 | 3/1952 | Poorman et al. | 117/105 |
| 2,964,420 | 6/1955 | Poorman et al. | 117/21 |
| 3,254,970 | 8/1961 | Dittrich et al. | 29/103.5 |
| 3,530,892 | 3/1968 | Charlop et al. | 137/625.19 |
| 3,617,358 | 9/1967 | Dittrich | 264/117 |
| 3,655,425 | 7/1969 | Longo et al. | 29/191.2 |
| 3,723,165 | 10/1971 | Longo et al. | 260/47 C |
| 3,741,792 | 12/1970 | Peck et al. | 117/46 FC |
| 3,784,405 | 10/1971 | Economy et al. | 117/132 C |
| 4,416,421 | 7/1981 | Browning | 239/79 |

*Primary Examiner*—Bernard Pianalto

*Attorney, Agent, or Firm*—H. S. Ingham; E. T. Grimes

[57] ABSTRACT

A method for producing a dense and tenacious coating with a thermal spray gun including a nozzle member and a gas cap. The gas cap extends from the nozzle and has an inwardly facing cylindrical wall defining a combustion chamber with an open end and an opposite end bounded by the nozzle. An annular flow of a combustible mixture is injected at a pressure of at least two bar above atmospheric pressure from the nozzle coaxially into the combustion chamber. An annular outer flow of pressurized air is injected from the nozzle adjacent to the cylindrical wall. Powder particles having a heat-stable, non-fusible component and a heat-softenable component, and entrained in a carrier gas, are fed axially from the nozzle into the combustion chamber. An annular inner flow of pressurized air is injected from the nozzle into the combustion chamber coaxially between the combustible mixture and the powder-carrier gas. Upon combusting the annular mixture a supersonic spray stream containing the powder is propelled through the open end to produce a coating.

10 Claims, 3 Drawing Sheets

HIGH VELOCITY POWDER THERMAL SPRAY METHOD FOR SPRAYING NON-MELTABLE MATERIALS

This invention relates to thermal spraying and particularly to a method for combustion thermal spraying powder at very high velocity.

BACKGROUND OF THE INVENTION

Thermal spraying, also known as flame spraying, involves the melting or at least heat softening of a heat fusible material such as metal or ceramic, and propelling the softened material in particulate form against a surface which is to be coated. The heated particles strike the surface where they are quenched and bonded thereto. A thermal spray gun is used for the purpose of both heating and propelling the particles. In one type of thermal spray gun, the heat fusible material is supplied to the gun in powder form. Such powders are typically comprised of small particles, e.g., between 100 mesh U.S. Standard screen size (149 microns) and about 2 microns. Heat for powder spraying is generally from a combustion flame or an arc-generated plasma flame. The carrier gas, which entrains and transports the powder, may be one of the combustion gases or an inert gas such as nitrogen, or it may simply be compressed air.

Quality coatings of certain thermal spray materials have been produced by spraying at high velocity. Plasma spraying has proven successful with high velocity in many respects but it can suffer from non-uniform heating and/or poor particle entrainment which must be effected by feeding powder laterally into the high velocity plasma stream. U.S. Pat. Nos. 2,714,563 and 2,964,420 (both Poorman et al) disclose a detonation gun for blasting powdered material in a series of detonations to produce coatings such as metal bonded carbides. High density and tenacity of coatings are achieved by high impact of the powder particles, and the short dwell time in the heating zone minimizes oxidation at the high spray temperatures.

A rocket type of powder spray gun can produce excellent coatings of metals and metal bonded carbides, particularly tungsten carbide, and is typified in U.S. Pat. Nos. 3,741,792 (Peck et al.) and 4,416,421 (Browning). This type of gun has an internal combustion chamber with a high pressure combustion effluent directed through a nozzle chamber. Powder is fed laterally into the flame or into the nozzle chamber to be heated and propelled by the combustion effluent.

Short-nozzle spray devices are disclosed for high velocity spraying in French Patent No. 1,041,056 and U.S. Pat. No. 2,317,173 (Bleakley). Powder is fed axially into a melting chamber within an annular flow of combustion gas. An annular air flow is injected coaxially outside of the combustion gas flow, along the wall of the chamber. The spray stream with the heated powder issues from the open end of the combustion chamber.

Since thermal spraying involves melting or at least surface heat softening the spray material, non-meltable powders such as certain carbides and nitrides cannot be sprayed into successful coatings without incorporating a binder into the material. For example, powders may be formed by cladding a metal onto a core of non-meltable material as disclosed in U.S. Pat. No. 3,254,970 (Dittrich et al.) or vice versa as disclosed in U.S. Pat. No. 3,655,425 (Longo and Patel). However, such compositioning has not been fully sufficient for producing high quality coatings and optimum deposit efficiency with conventional thermal spray guns, vis. plasma or low velocity combustion.

Thermoplastic polymer powders such as polyethylene melt easily and many can readily be thermal sprayed. However, thermoset polymer powders generally do not melt, at least without first decomposing and/or oxidizing at the high thermal spraying temperature. Certain of these thermoset powders as disclosed in U.S. Pat. No. 3,723,165 (Longo and Durman) (assigned to the predecessor in interest of the present assignee) may undergo a superficial chemical or physical modification of the polymer surface of each particle so as to become surface heat softenable. An example is the poly (paraoxybenzoyl) ester powder described in U.S. Pat. No. 3,784,405 (Economy et al). As further explained in Example 1 of the aforementioned U.S. Pat. No. 3,723,165 such polyester may be utilized in a blend with aluminum alloy powder. Plasma spraying such a blend has been highly successful for producing abradable coatings for gas turbine engine seals and the like. However, the basic unmeltability of the polymer still results in poor deposit efficiency, so that even with the high heat available from a plasma gun, a significant portion of the polymer constituent is lost. Since this polymer is quite expensive, there is a need to improve the thermal spraying of the polymer-aluminum blend. There also has been an on-going need for improvements in abradability and erosion resistance of the coatings.

Therefore, objects of the present invention are to provide an improved method for thermal spraying non-meltable materials, to provide a method for high velocity thermal spraying particles having a non-meltable component and a heat softenable component, to provide an improved method of including non-meltable particles in thermal sprayed coatings at reasonable cost, to provide a method for thermal spraying improved coatings of certain nonmeltable carbides and nitrides, and to provide a method for producing improved coatings of certain thermoset plastics.

SUMMARY OF THE INVENTION

The foregoing and other objects are achieved by a method for producing a coating with a thermal spray gun having a tubular member defining a combustion chamber therein with an open end for propelling combustion products into the ambient atmosphere at supersonic velocity. The method comprises injecting into the chamber a combustible mixture of combustion gas and oxygen at a pressure in the chamber of at least two atmospheres above ambient atmospheric pressure, feeding into the chamber a powder comprising a heat-stable non-meltable polymer, combusting the combustible mixture in the chamber whereby a supersonic spray stream containing the powder is propelled through the open end, and directing the spray stream toward a substrate such as to produce a coating thereon.

The powder particles comprise thermoset polymer grains characterized by being surface heat softenable by flame modification. Preferably, the polymer grains comprise poly(paraoxybenzoyl)ester, and the powder further comprises aluminum powder or aluminum base alloy powder.

In a preferred method, the thermal spray gun includes a nozzle member with a nozzle face and a tubular gas cap extending from the nozzle member and having an inwardly facing cylindrical wall defining a combustion chamber with an open end and an opposite end bounded by the nozzle face. This method comprises injecting an annular flow of combustible mixture of a combustion gas and oxygen from the nozzle coaxially into the combustion chamber at a pressure therein of at least two bar above atmospheric pressure, injecting an annular outer flow of pressurized non-combustible gas adjacent to the cylindrical wall radially outward of the annular flow of the combustible mixture, feeding a powder comprising particles having heat stable non-meltable cores and heat softenable surfaces in a carrier gas axially from the nozzle into the combustion chamber, injecting an annular inner flow of pressurized gas from the nozzle member into the combustion chamber coaxially between the combustible mixture.

DETAILED DESCRIPTION OF THE INVENTION

Figure 1:
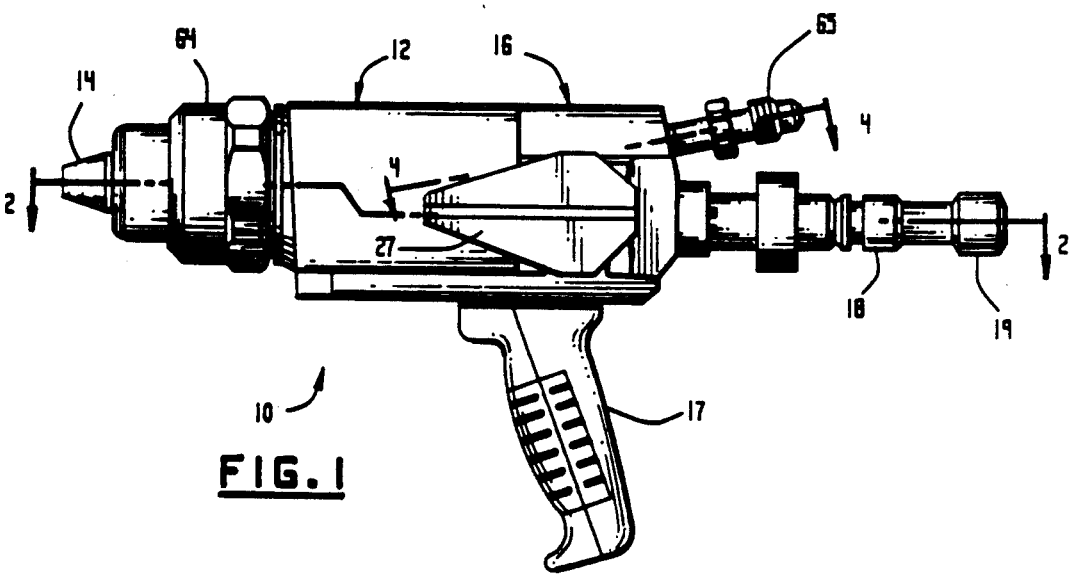
FIG. 1 is an elevation of a thermal spray gun used in the present invention.
Figure 2:
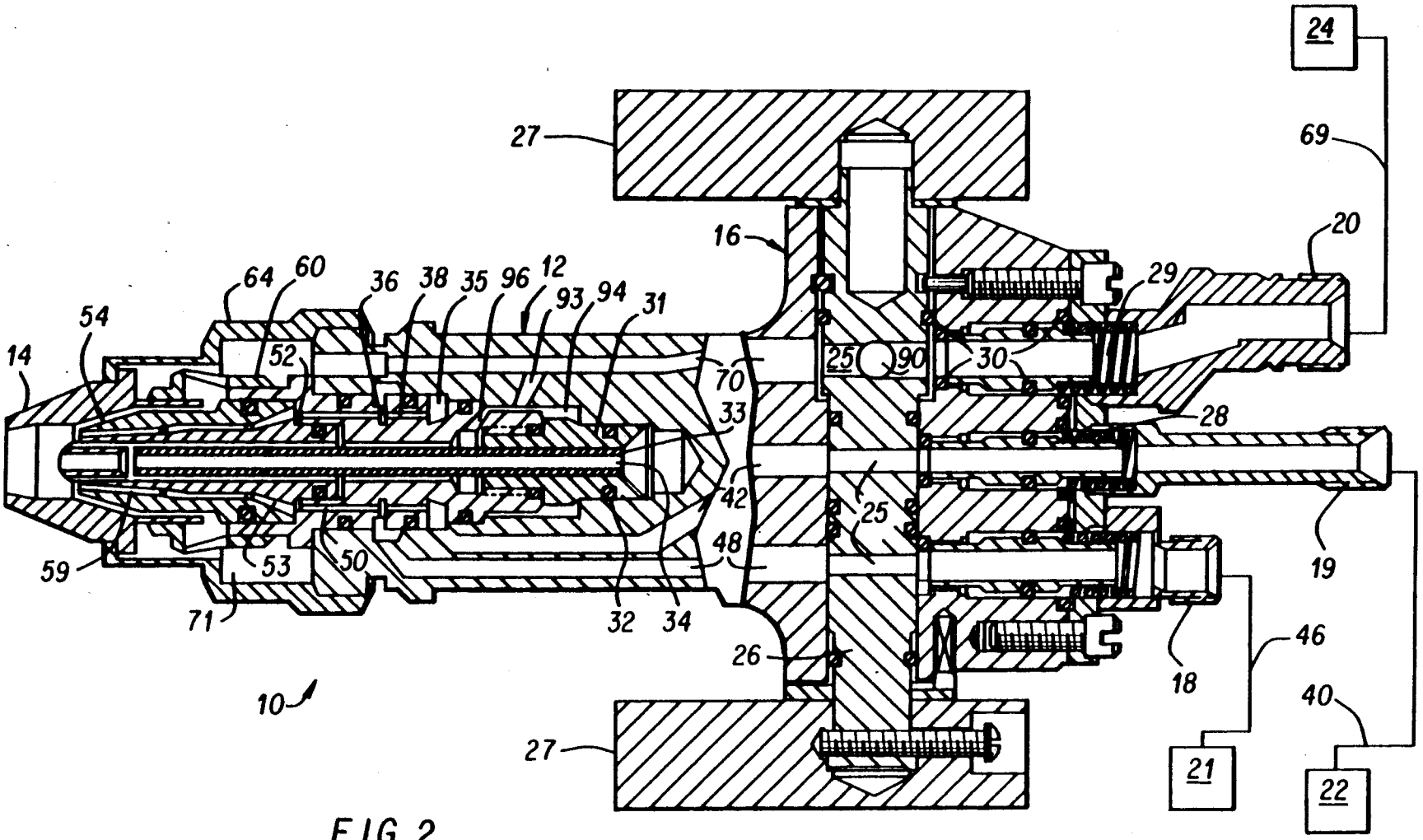
FIG. 2 is a section taken at 2—2 of FIG. 1.

An example of a preferred thermal spray apparatus for effecting the present invention is disclosed in copending U.S. patent application Ser. No. 193,030 filed May 11, 1988, now U.S. Pat. No. 4,865,252 assigned to the assignee of the present invention and detailed herein. The apparatus is illustrated in FIG. 1, and FIG. 2 shows a horizontal section thereof. A thermal spray gun 10 has a gas head 12 with a tubular member in the form of a gas cap 14 mounted thereon, a valve portion 16 for supplying fuel, oxygen and air to the gas head, and a handle 17. The valve portion 16 has a hose connection 18 for a fuel gas, a hose connection 19 for oxygen and a hose connection 20 for air. The three connections are connected respectively by hoses from a fuel source 21, oxygen source 22 and air source 24. Orifices 25 in a cylindrical valve 26 control the flow of the respective gases from their connections into the gun. The valve and associated components are, for example, of the type taught in U.S. Pat. No. 3,530,892, and include a pair of valve levers 27, and sealing means for each gas flow section that include plungers 28, springs 29 and O-rings 30.

A cylindrical siphon plug 31 is fitted in a corresponding bore in gas head 12, and a plurality of O-rings 32 thereon maintain a gas-tight seal. The siphon plug is provided with a tube 33 having a central passage 34 The siphon plug further has therein an annular groove 35 and a further annular groove 36 with a plurality of inter-connecting passages 38 (two shown). With cylinder valve 26 in the open position as shown in FIG. 2, oxygen is passed by means of a hose 40 through its connection 19 and valve 26 into a passage 42 from whence it flows into groove 35 and through passage 38. A similar arrangement is provided to pass fuel gas from source 21 and a hose 46 through connection 18, valve 26 and a passage 48 into groove 36, mix with the oxygen, and pass as a combustible mixture through passages 50 aligned with passages 38 into an annular groove 52. Annular groove 52 feeds the mixture into a plurality of passages 53 in the rear section of a nozzle member 54.

Figure 3:
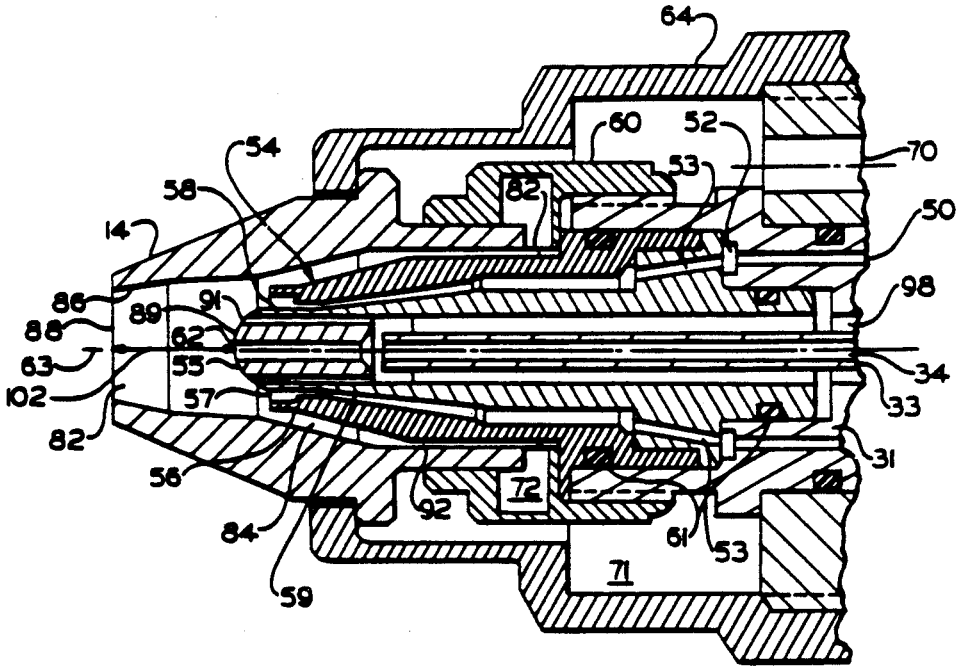
FIG. 3 is an enlargement of the forward end of the section of FIG. 2.

Referring to FIG. 3 for details, nozzle member 54 is conveniently constructed of a tubular inner portion 55 and a tubular outer portion 56. (As used herein and in the claims, "inner" denotes toward the axis and "outer" denotes away from the axis. Also "forward" or "forwardly" denotes toward the open end of the gun; "rear", "rearward" or "rearwardly" denotes the opposite.) Outer portion 56 defines an outer annular orifice means for injecting the annular flow of the combustible mixture into the combustion chamber. The orifice means preferably includes a forward annular opening 57 with a radially inward side bounded by an outer wall 58 of the inner portion. The orifice system leading to the annular opening from passages 53 may be a plurality of arcuately spaced orifices, but preferably is an annular orifice 59.

The combustible mixture flowing from the aligned grooves 52 thus passes through the orifice (or orifices) 59 to produce an annular flow which is ignited in annular opening 57. A nozzle nut 60 holds nozzle 54 and siphon plug 28 on gas head 12. Two further O-rings 61 are seated conventionally between nozzle 54 and siphon plug 31 for gas tight seals. The burner nozzle 54 extends into gas cap 4 which is held in place by means of a retainer ring 64 and extends forwardly from the nozzle.

Figure 4:
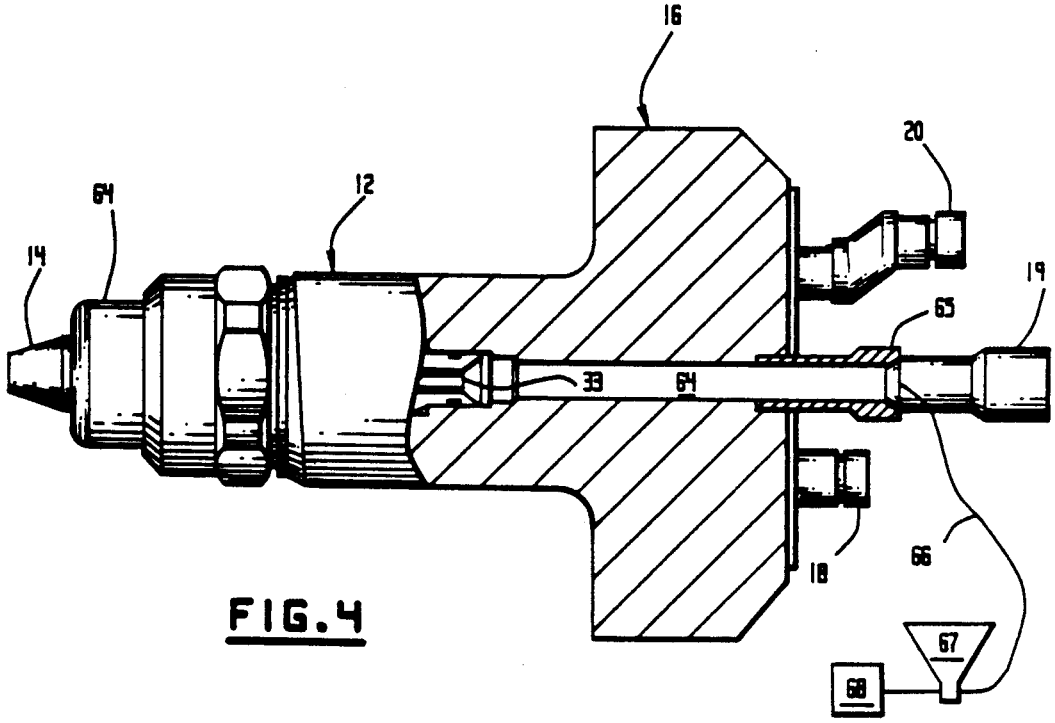
FIG. 4 is a section taken at 4—4 of FIG. 1, and a schematic of an associated powder feeding system.

Nozzle member 54 is also provided with an axial bore 62, for the powder in a carrier gas, extending forwardly from tube passage 33. Alternatively the powder may be injected through a smalldiameter ring of orifices (not shown) proximate the axis 63 of the gun. With reference to FIG. 4 a diagonal passage 64 extends rearwardly from tube 33 to a powder connection 65. A carrier hose 66 and, therefore, central bore 62, is receptive of powder from a powder feeder 67 entrained in a carrier gas from a pressurized gas source 68 such as compressed air by way of feed hose 66. Powder feeder 67 is of the conventional or desired type but must be capable of delivering the carrier gas at high enough pressure to provide powder into the chamber 82 in gun 10.

With reference back to FIGS. 2 and 3, air or other noncombustible gas is passed from source 24 and a hose 69 through its connection 20, cylinder valve 26, and a passage 70 to a space 71 in the interior of retainer ring 64. Lateral openings 72 in nozzle nut 60 communicate space 71 with a cylindrical combustion chamber 82 in gas cap 14 so that the air may flow as an outer sheath from space 71 through these lateral openings 72, thence through an annular slot 84 between the outer surface of nozzle 54, and an inwardly facing cylindrical wall 86 defining combustion chamber 82 into which slot 84 exits. The flow continues through chamber 82 as an annular outer flow mixing with the inner flows, and out of the open end 88 in gas cap 14. Chamber 82 is bounded at its opposite, rearward end by face 89 of nozzle 54.

Preferably combustion chamber 82 converges forwardly from the nozzle at an angle with the axis, most preferably between about 2° and 10°, e.g. 5°. Slot 84 also converges forwardly at an angle with the axis, most preferably between about 12° and 16°, e.g. 14.5°. Slot 84 further should have sufficient length for the annular air flow to develop, e.g. comparable to chamber length 102, but at least greater than half of such length 102. In addition, the chamber should converge at a lesser angle than the slot, most preferably between about 8° and 12°, e.g. 10° less. This configuration provides a converging air flow with respect to the chamber to minimize powder buildup on the chamber wall.

The air flow rate should be controlled upstream of slot 84 such as in a rearward narrow orifice 92 or with a separate flow regulator. For example slot length is 8 mm, slot width is 0.38 mm on a 15 mm circle, and air pressure to the gun (source 24) is 4.9 kg/cm$^2$ (70 psi) to produce a total air flow of 425 std l/min (900 scfh) with a pressure of 4.2 kg/cm$^2$ (60 psi) in chamber 82. Also, with valve 26 in a lighting position aligning bleeder holes as described in aforementioned U.S. Pat. No. 3,530,892, an air hole 90 in valve 26 allows air flow for lighting, and the aboveindicated angles and dimensions are important to allow such lighting without backfire. (Bleeder holes in valve 26 for oxygen and fuel for lighting, similar to air hole 90, are not shown.)

The inner portion 55 of nozzle member 54 has therein a plurality of parallel inner orifices 91 (e.g. 8 orifices 0.89 mm diameter) on a bolt circle (e.g. 2.57 mm diameter) which provide for an annular inner sheath flow of gas, preferably air, about the central powder feed issuing from bore 62 of the nozzle. This inner sheath of air contributes significantly to reducing any tendency of buildup of powder material on wall 86. The sheath air is conveniently tapped from passage 70, via a duct 93 (FIG. 2) to an annular groove 94 around the rear portion of siphon plug 31 and at least one orifice 96 into an annular space 98 adjacent tube 33. Preferably at least three such orifices 96 are equally spaced arcuately to provide sufficient air and to minimize vortex flow which could detrimentally swirl the powder outwardly to wall 86 of chamber 82. The inner sheath air flow should be between 1% and 10%, preferably about 2% and 5% of the outer sheath flow rate, for example about 3%. The inner sheath may alternatively be regulated independently of the outer sheath air, for better control.

Chances of powder buildup are further minimized by having the inner portion 55 of the nozzle member protrude into chamber 82 forwardly of the outer portion 56 as depicted in FIGS. 2 and 3. A chamber length 102 may be defined as the shortest distance from nozzle face 89 to open end 88, i.e. from the forwardmost point on the nozzle to the open end. The forwardmost point on the inner portion should protrude forwardly from the outer portion 56 by a distance between about 10% and 40% of chamber length 102, e.g. 30%.

A preferred configuration for the inner portion is depicted in FIGS. 2 and 3. Referring to the outer wall 58 of inner portion 55 of the nozzle, which defines annular opening 57, such wall 58 should extend forwardly from the annular opening with a curvature inward toward the axis. The curvature should be uniform. For example, as shown, the curvature is such as to define a generally hemispherical face 89 on inner portion 58. It is believed that the combustion flame is thereby drawn inwardly to maintain the flows away from chamber wall 86.

As an example of further details of a thermal spray gun incorporating the present invention, siphon plug 31 has 8 oxygen passages 38 of 1.51 mm each to allow sufficient oxygen flow, and 1.51 mm diameter passages 50 for the gas mixture. In this gas head central bore 62 is 3.6 mm diameter, and the open end 88 of the gas cap is 0.95 cm from the face of the nozzle (length 102). Thus the combustion chamber 82 that also entrains the powder is relatively short, and generally should be between about one and two times the diameter of open end 88.

A supply of each of the gases to the cylindrical combustion chamber is provided at a sufficiently high pressure, e.g. at least 30 psi above atmospheric, and is ignited conventionally such as with a spark device, such that the mixture of combusted gases and air will issue from the open end as a supersonic flow entraining the powder. The heat of the combustion will at least heat soften the powder material such as to deposit a coating onto a substrate. Shock diamonds should be observable. Because of the annular flow configuration, an expansion type of nozzle exit is not necessary to achieve the supersonic flow.

Figure 5:
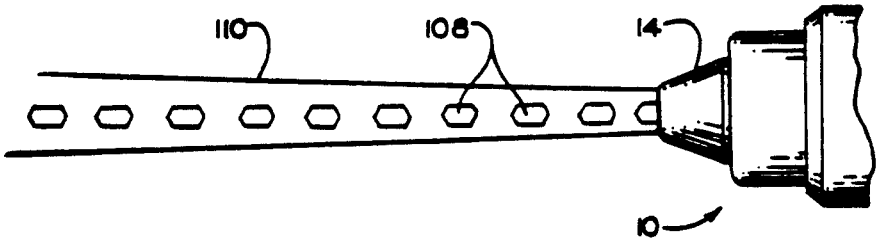
FIG. 5 is a schematic view of the gun of FIG. 1 producing a supersonic spray stream according to the present invention.
Figure 6:
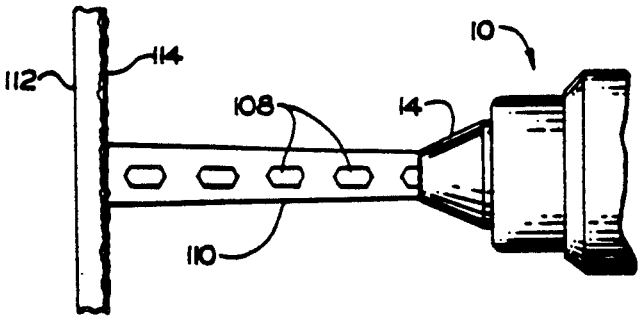
FIG. 6 is the view of FIG. 5 with a substrate in place.

The combustion gas may be propane or hydrogen or the like, but it is preferable that the combustion gas be propylene gas, or methylacetylene-propadiene gas ("MPS"). These latter gases allow a relatively high velocity spray stream and excellent coatings to be achieved without backfire. For example with a propylene or MPS pressure of about 7 kg/cm$^2$ gauge (above atmospheric pressure) to the gun, oxygen at 10 kg/cm$^2$ and air at 5.6 kg/cm$^2$ at least 8 shock diamonds are readily visible in the spray stream without powder flow. The appearance of these shock diamonds 108 in spray stream 110 is illustrated in FIG. 5. The position of the substrate 112 on which a coating 114 is sprayed is preferably about where the fifth full diamond would be as shown in FIG. 6, e.g. about 9 cm spray distance.

According to the method of the present invention certain powders are thermal sprayed with supersonic combustion spray guns. Although the preferred apparatus is as described above, the method may alternatively utilize other supersonic guns such as described in the aforementioned U.S. Pat. No. 4,416,421. The certain powders are those that contain a heat-stable, non-meltable component in each powder grain. As used herein and in the claims the term "heat-stable" means that the referenced component will not substantially decompose or oxidize under the temperature and time conditions of the flame of the thermal spray gun; similarly the term "non-meltable" means that the referenced component will not substantially melt in the flame. As a test, the non-meltable component may be fed through a thermal spray gun to be used for the spraying thereof, collected and inspected microscopically and/or metallographically for decomposing, oxidizing or melting. For example, normal flattening of the particles on a substrate will indicate melting. Thus material that merely softens viscously, without a specific melting point to allow flattening on a substrate, is non-meltable for the purpose of this invention. Published handbooks on melting points are alternate sources of meltability information.

One group of heat-stable non-meltable materials contemplated for use in the present invention are non-meltable minerals. Examples of such materials are graphite; diamond powder; non-meltable carbides such as silicon carbide and aluminum carbide; and non-meltable nitrides such as silicon nitride, chromium nitride, boron nitride and aluminum nitride The mineral need not be naturally occurring. Silicon carbide and boron nitride are particularly preferable as described minerals to incorporate into coatings. The non-meltable material may be a heat stable thermoset polymer such as polyimide that is virtually unaffected by the thermal spray flame except for surface effects.

The non-meltable minerals, according to the invention, are composited with a meltable or at least a heat softenable component. Generally this component is a conventional thermal spray metal such as an iron-group element, molybdenum, aluminum, copper, or an alloy of any of these, or may be an oxide such as alumina, titania, zirconia, or chromia, or a complex oxide.

The composite powder is produced by the known or desired method. For example, metal clad mineral may be made by cladding the metal onto a mineral core as disclosed in the aforementioned U.S. Pat. No. 3,254,970 (e.g. nickel clad diamond), by cladding fine mineral powder onto a metal core as disclosed in the aforementioned U.S. Pat. No. 3,655,425 (e.g. boron nitride clad nickel alloy), or by agglomerating or spray drying fine powders of both components as disclosed in U.S. Pat. No. 3,617,358 (Dittrich).

A second group of heat-stable non-metallic materials contemplated for the method herein consists of thermoset polymers. Thermoset is used broadly herein and in the claims to conventionally cover hydrocarbons (plastics) polymerized by heat, catalyst or reaction whereby the polymer is not ordinarily softenable by heating, for example without some chemical modification by the flame. The poly (paraoxybenzoyl) ester and copolyesters thereof of the aforementioned U.S. Pat. Nos. 3,723,165 and 3,784,405 fall in this group, as may others such as certain epoxies and polyimides including those that may be in the form of an incompletely polymerized powder. A feature of these selected polymers is that only a surface portion is heat softened in the flame. This surface softening maybe is effected by chemical modification during the short exposure to the hot flame, changing a surface layer from thermoset to at least partially thermoplastic. Thus, for the purpose of the presently claimed invention, the surface layer is effectively a heat-softenable component and the core remains a heat-stable non-meltable component, even though the initial particle may be homogeneous. Alternatively a nonmeltable thermoset polymer may be clad or otherwise composited with a meltable polymer such as polyamide, polyethylene or incompletely polymerized polyester or epoxy, or a copolyester of the type disclosed in aforementioned U.S. Pat. No. 3,784,405. Characteristic powder according to the invention may be sprayed neat or blended with a more conventional thermal spray material such as a metal. Quite surprisingly, the method of supersonic combustion thermal spraying of the above-described powders is effected with relatively high deposit efficiency, and produces dense, high quality coatings. The high deposit efficiency is especially surprising because the short dwell time of particles in the supersonic flame would be expected to cause lesser deposit efficiency, especially with non-meltable components. The improved deposit efficiency provides not only a cost benefit per se but allows cost-favorable modification of blends to achieve a specified coating composition.

A preferred example is a blend of heat-stable polyester and aluminum alloy, as detailed in Example 1 below. Conventional plasma spraying, despite high heat, loses a considerable portion of the polyester relative to the alloy. Conventional, low-velocity combustion spraying chars the polyester or, with lesser heat, results in poorly cohesive deposits. Spraying with a supersonic combustion flame provides high deposit efficiency which allows a lesser proportion of polyester to be in the initial blend to obtain the originally specified proportions in the coating, and provides excellent coatings.

EXAMPLE 1

A blend of polyester plastic and aluminum alloy similar to the blend is prepared as described under Example 1-A of aforementioned U.S. Pat. No. 3,723,165, except the plastic powder is 30% and the alloy is 70% by weight of the blend. The plastic is a high temperature aromatic poly (paraoxybenzoyl) ester sold under the trade name of EKONOL TM by the Metaullics Division of the Carboundary Company, Sanborn, N.Y. and has a size of −88 +44 microns, and the alloy is aluminum 12% silicon with a size of −44 +10 microns.

The blend is sprayed with the preferred apparatus described above with respect to FIGS. 1–3, specifically a Metco Type DJ TM Gun sold by The Perkin-Elmer Corporation, Westbury, N.Y., using a #3 insert, #3 injector, "A" shell, #2 siphon plug and #2 air cap. Oxygen was 10.5 kg/cm$^2$ (150 psig) and 212 l/min (450 scfh), propylene gas at 7.0 kg/cm$^2$ (100 psig) and 47 l/min (100 scfh), and air at 5.3 kg/cm$^2$ (75 psig) and 290 l/min (615 scfh). A high pressure powder feeder of the type disclosed in the present assignee's copending U.S. patent application Ser. No. 260,625 filed Oct. 21, 1988, now U.S. Pat. No. 4,900,199, and sold as a Metco Type DJP powder feeder by Perkin-Elmer is used to feed the powder blend at 23 gm/min (3 lb/hr) in a nitrogen carrier at 8.8 kg/cm$^2$ (125 psig) and 7 l/min (15 scfh). Spray distance is 20 cm and the substrate is grit blasted nickel alloy.

Comparisons were made with the 40% powder and spraying thereof of Example 1-A of the '165 patent, the 40% powder being sold as Metco 601NS by Perkin-Elmer and containing 40% plastic powder, i.e. ⅓ more than the present 30% powder. The Example 1-A 40% powder was plasma sprayed conventionally with argon-hydrogen plasma gas. The 30% powder blend sprayed with the supersonic combustion gun yielded a deposit efficiency of 85%, vs typical 65% deposit efficiency for the 40% powder plasma sprayed. Of more importance is the fact that the coatings were of essentially the same composition as each other, reflecting the better deposit efficiency of the plastic constituent of the 30% powder with the supersonic combustion gun. Abradability and erosion resistance of the coatings were also essentially the same. Porosity for the high velocity coating was about 1% and uniformly dispersed, vs 5% non-uniform porosity for plasma sprayed 40% powder. Hardness for the high velocity coating was R15y 78 to 83, vs 65 to 75, i.e., again more uniform.

EXAMPLE 2

Nickel clad silicon carbide powder is prepared from −44 +5 micron silicon carbide powder. This is clad with nickel in the known manner by the hydrogen reduction of an ammoniacal solution of nickel and ammonium sulphate, using anthraquinone as the coating catalyst. Details of the coating process are taught in aforementioned U.S. Pat. No. 3,254,970. The resulting powder containing 29% by weight silicon carbide, balanced nickel is screened to −53 microns.

The screened powder is sprayed with the apparatus of Example 1 with a #2 insert, #2 injector, "A" shell, #2 siphon plug and #3 air cap. Oxygen is at 10.5 kg/cm$^2$ (150 psig) and 286 l/min (606 scfh), propylene at 7.0 kg/cm$^2$ (100 psig) and 79 l/min (168 scfh), and air at 5.3 kg/cm$^2$ (75 psig) and 374 l/min (793 scfh). Powder feeder and carrier gas are the same as in Example 1 with a feed rate of 47 gm/min (6 lb/hr). Spray distance is 15 cm (6 inches) and the substrate is grit blasted mild steel.

Excellent, dense coatings were effected containing a high retained percentage and uniform distribution of silicon carbide. No discernable embrittlement was formed metallographically at nickel/silicon carbide particle interfaces, otherwise found in more conventional thermal sprayed coatings of such material, apparently due to short dwell time in the flame.

EXAMPLE 3

A powder of nickel-chromium-iron alloy core clad with fine particles of aluminum (3.5%) and boron nitride (5.5%), of the type described in aforementioned U.S. Pat. No. 3,655,425 and sold as Metco 301NS by Perkin-Elmer is sprayed with the same gun and similar parameters as for Example 2. Dense, uniform coatings having an excellent combination of abradability and erosion resistance are effected.

EXAMPLE 4

Composite aluminum-graphite powder sold as Metco 310NS by Perkin-Elmer is produced by agglomerating fine aluminum −12% silicon −45 +10 microns) and 23% of graphite powder with 8% of an organic binder by the method used for making the powder of Example 3. This powder is sprayed with the same gun and similar parameters as for Example 2. Dense, uniform coatings having an excellent combination of abradability and erosion resistance are effected.

Example 5

Example 1 is repeated except that the polyester is replaced with a copolyester of recurring units of Formula I, III, and IV as disclosed in the aforementioned U.S. Pat. No. 3,784,405 (incorporated herein by reference) and sold as Xydar TM by Dartco Manufacturing Inc., Augusta Ga. Similar results are effected.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A method for producing a dense and tenacious coating with a thermal spray gun including a nozzle member with a nozzle face, and a tubular gas cap extending from the nozzle member and having an inwardly facing cylindrical wall defining a combustion chamber with an open end and an opposite end bounded by the nozzle face, the method comprising injecting an annular flow of a combustible mixture of a combustion gas and oxygen from the nozzle coaxially into the combustion chamber at a steady pressure therein of at least two bar above atmospheric pressure, injecting an annular outer flow of pressurized non-combustible gas adjacent to the cylindrical wall radially outward of the annular flow of the combustible mixture, feeding a powder comprising polymer particles having heat stable non-meltable cores and heat softenable surfaces in a carrier gas axially from the nozzle into the combustion chamber, injecting an annular inner flow of pressurized gas from the nozzle member into the combustion chamber coaxially between the combustible mixture and the powder-carrier gas, combusting the combustible mixture, whereby a supersonic spray stream containing the heat fusible material in finely divided form is propelled through the open end, and directing the spray stream toward a substrate such as to produce a coating thereon.

2. A method for producing a coating with a thermal spray gun having a tubular member defining a combustion chamber therein with an open end for propelling combustion products into the ambient atmosphere at supersonic velocity, the method comprising injecting into the chamber a combustible mixture of combustion gas and oxygen at a steady pressure in the chamber of at least two atmospheres above ambient atmospheric pressure, feeding into the chamber a powder comprising particles having a heat-stable non-meltable polymer component and a metallic component, combusting the combustible mixture in the chamber whereby a supersonic spray stream containing the powder is propelled through the open end, and directing the spray stream toward a substrate such as to produce a coating thereon, wherein the polymer comprises thermoset polymer grains characterized by being surface heat softenable by the spray stream.

3. A method according to claim 2 wherein the combustible mixture is injected at a sufficient pressure into the combustion chamber to produce at least 8 visible shock diamonds in the spray stream in the absence of powder-carrier gas feeding.

4. A method according to claim 3 further comprising selecting the combustion gas from the group consisting of propylene gas and methylacetylene-propadiene gas.

5. A method for producing a coating with a thermal spray gun having combustion chamber means therein with a combustion chamber and an open channel for propelling combustion products into the ambient atmosphere at supersonic velocity, the method comprising feeding through the open channel powder particles comprising a heat-stable non-meltable polymer, injecting into the chamber and combusting therein a combustible mixture of combustion gas and oxygen at a pressure in the chamber sufficient to produce a supersonic spray stream containing the powder issuing through the open channel, and directing the spray stream toward a substrate so as to produce a coating thereon, wherein the polymer comprises thermoset polymer grains characterized by being surface heat softenable by the spray stream.

6. A method according to claim 1 wherein the polymer grains comprise poly(paraoxybenzoyl)ester.

7. A method according to claim 6 wherein the polymer grains consist essentially of poly(paraoxybenzoyl)ester.

8. A method according to claim 6 wherein the polymer grains consist essentially of a copolyester of poly(-paraoxbenzoyl)ester.

9. A method according to claim 6 wherein the powder further comprises aluminum metallic component or aluminum base alloy powder.

10. A method according to claim 5 wherein the powder particles further comprise metallic particles.

* * * * *